US006330843B1

(12) United States Patent
Lin

(10) Patent No.: US 6,330,843 B1
(45) Date of Patent: Dec. 18, 2001

(54) RATCHET SCREWDRIVER WITH ROTATION CONTROL MECHANISM

(76) Inventor: Chang-Ming Lin, 331, Chang Chun St., Chiu Te Village, Wu Jih Hsiang, Taichung Hsien (TW)

( * ) Notice: Subject to any disclaimer, the term of this patent is extended or adjusted under 35 U.S.C. 154(b) by 0 days.

(21) Appl. No.: 09/610,018

(22) Filed: Jul. 5, 2000

(51) Int. Cl.[7] ..... B25B 13/46
(52) U.S. Cl. ..... 81/63.1; 81/62
(58) Field of Search ..... 81/60, 61, 62, 81/63, 63.1, 63.2

(56) References Cited

U.S. PATENT DOCUMENTS 5,379,873 * 1/1995 Shiao ..... 81/63.1
5,642,794 * 7/1997 Chuang et al. ..... 81/63.1
5,910,196 * 6/1999 Huang ..... 81/63.1
6,186,031 * 2/2001 Shiao ..... 81/63.1
6,240,810 * 6/2001 Ho ..... 81/62

* cited by examiner

*Primary Examiner*—Joseph J. Hail, III
*Assistant Examiner*—Joni B. Danganan
(74) *Attorney, Agent, or Firm*—Harrison & Egbert

(57) ABSTRACT

A ratchet screwdriver comprises a handle, a ratchet seat body, a rotary shaft rod, a stop plate, an anti-reverse plate, a dial knob seat, a recovery spring, a housing, a lock member, and a screw tip. The ratchet seat body is provided with a slide slot which is in turn provided with two slide edges capable of sliding back and forth along with the anti-reverse plate to support two gears mounted on the rotary shaft rod, thereby making the assembly of the ratchet screwdriver relatively simple.

1 Claim, 7 Drawing Sheets

RATCHET SCREWDRIVER WITH ROTATION CONTROL MECHANISM

BACKGROUND OF THE INVENTION

1. Field of the Invention

The present invention relates generally to a screwdriver, and more particularly to a ratchet screwdriver.

2. Description of the Related Art

As shown in FIGS. 1 and 2, a ratchet screwdriver 10 of the prior art comprises a handle 11 having a main body 12 which is provided at the front end with an axial hole 14. A shaft 17 is received in the axial hole 14 such that a gear 15 of the shaft 17 is actuated by two anti-reverse plates 20. A stop plate 19 is received in an insertion slot 18 of the main body 12. The two anti-reverse plates 20 are provided with a dial knob seat 22 having two elastic press plates 21. A housing 24 is provided with a position confining hole 23 and is fitted into the front end of the main body 12 such that a cut edge 25 of the housing 24 is retained by a projection 26 of the main body 12. The main body 12 is provided at the front end with a locking member 28 having a receiving hole 27 into which the shaft 17 is slidably fitted. Such a prior art ratchet screwdriver as described above is rather complicated in construction and can not be easily assembled.

BRIEF SUMMARY OF THE INVENTION

The primary objective of the present invention is to provide a ratchet screwdriver which is simple in construction and can be easily assembled.

The features and the advantages of the present invention will be readily understood upon a thoughtful deliberation of the following detailed description of a preferred embodiment of the present invention with reference to the accompanying drawings.

BRIEF DESCRIPTION OF THE SEVERAL VIEWS OF THE DRAWINGS

FIG. 6-1 shows a detailed close-up view of the dial knob seat showing a neutral position thereof.

FIG. 6-2 shows a detailed close-up view of the dial knob seat showing a position for allowing rotation of the screwdriver in a second direction.

FIG. 7-1 is a cross-sectional view of the handle as taken across lines 7-1—7-1 of FIG. 6-1.

FIG. 7-2 is a cross-sectional view of the handle as taken across lines 7-2—7-2 of FIG. 6-2.

DETAILED DESCRIPTION OF THE INVENTION

Figure 1:
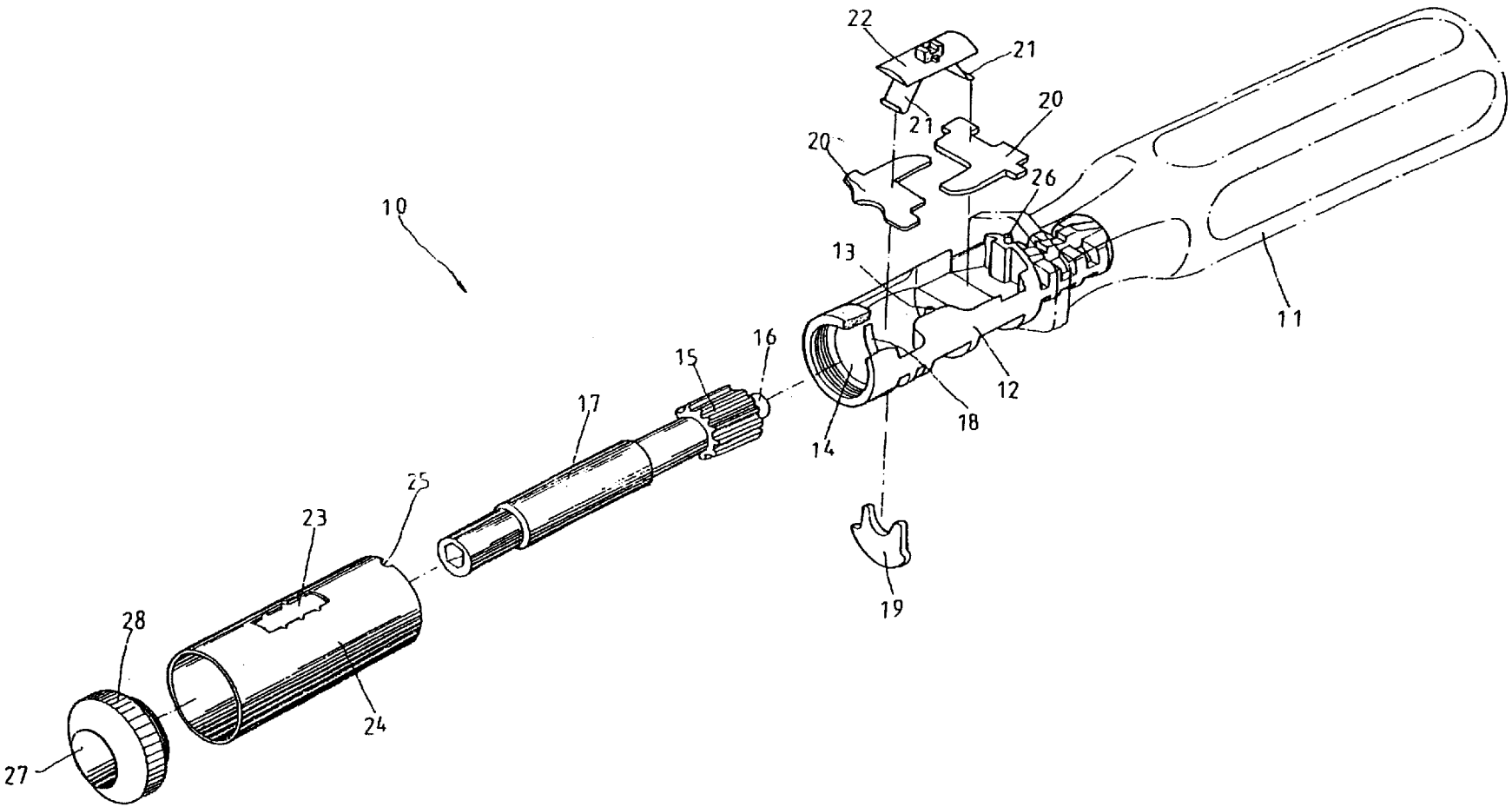
FIG. 1 PRIOR ART
FIG. 1 shows an exploded view of a ratchet screwdriver of the prior art.
Figure 2:
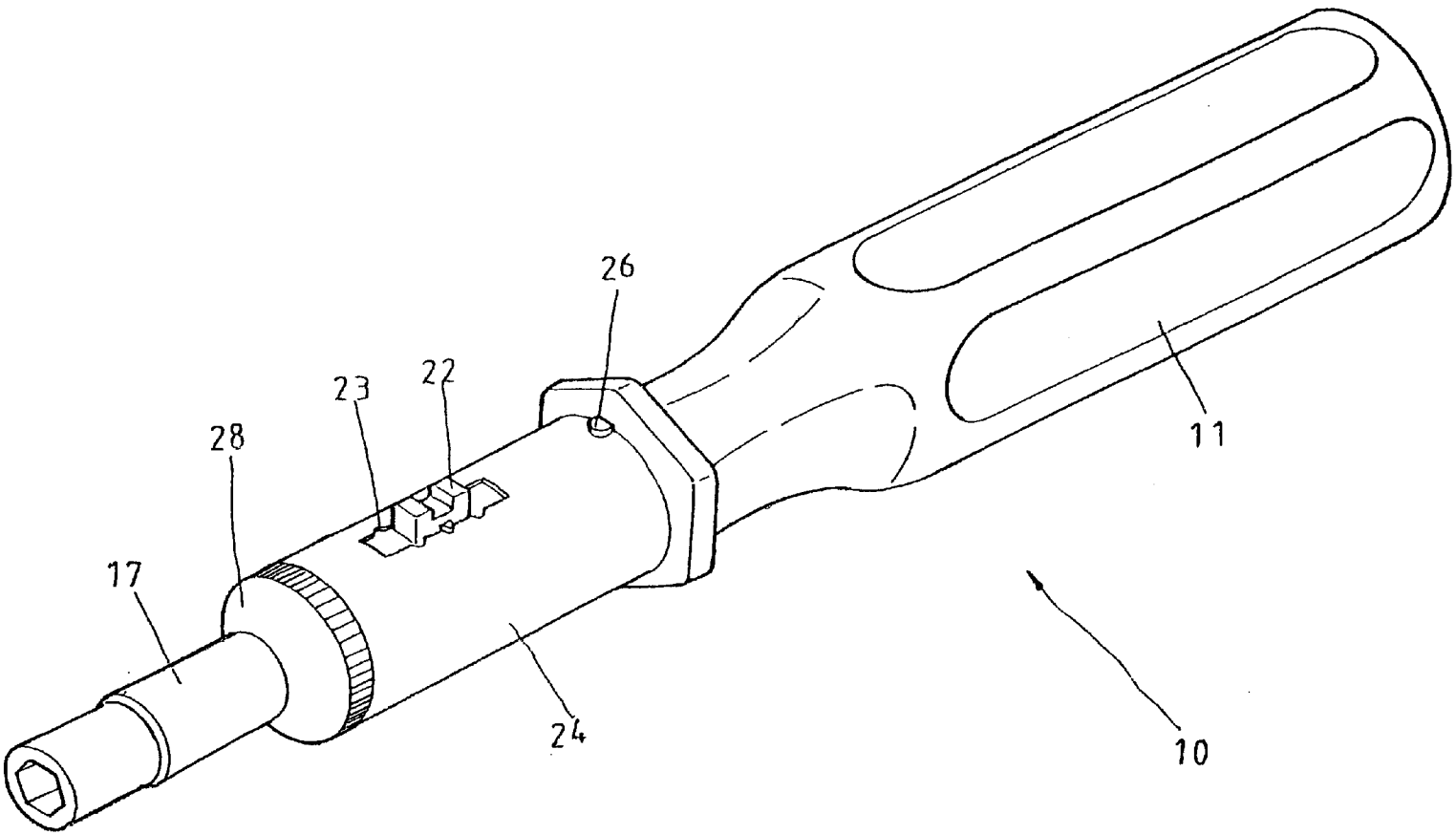
FIG. 2 PRIOR ART
FIG. 2 shows a perspective view of the ratchet screwdriver of the prior art.
Figure 3:
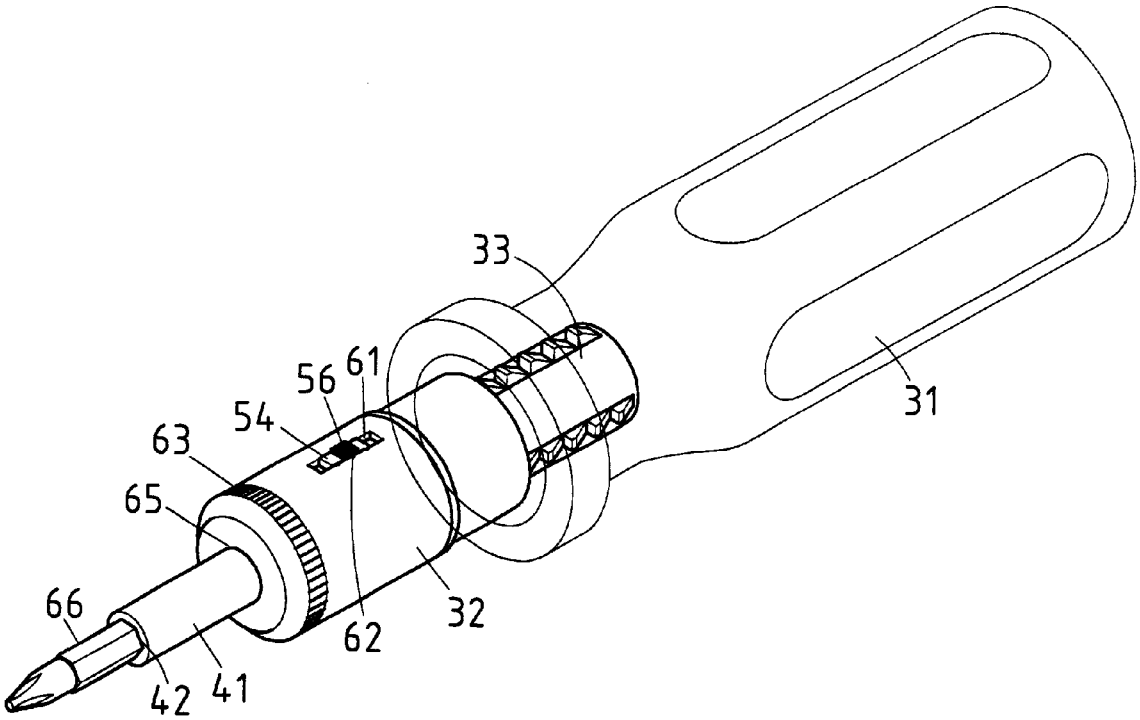
FIG. 3 shows a perspective view of a ratchet screwdriver of the present invention.
Figure 4:
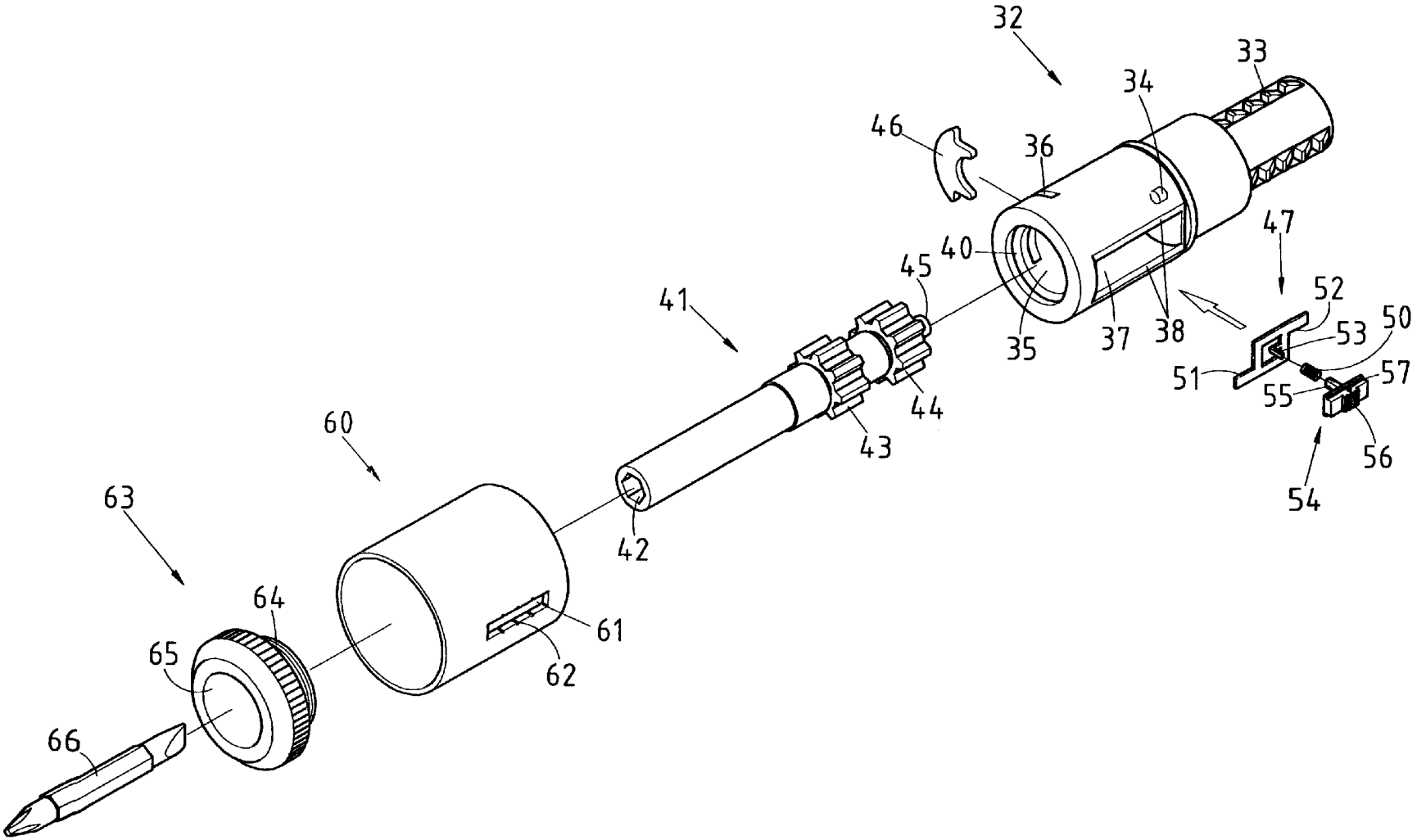
FIG. 4 shows an exploded view of the ratchet screwdriver of the present invention.
Figure 5:
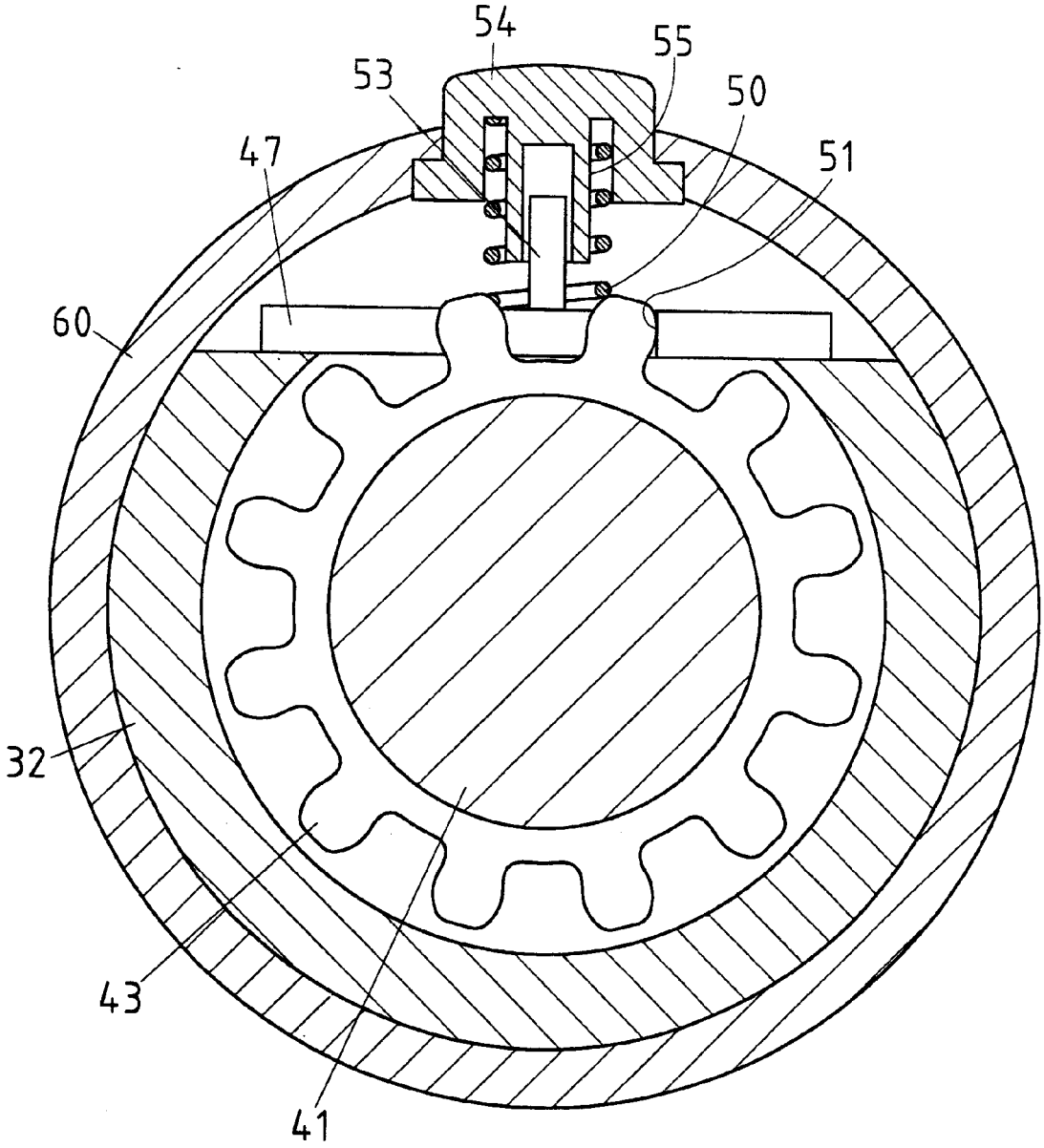
FIG. 5 shows a cross-sectional view of the present invention.
Figure 6:
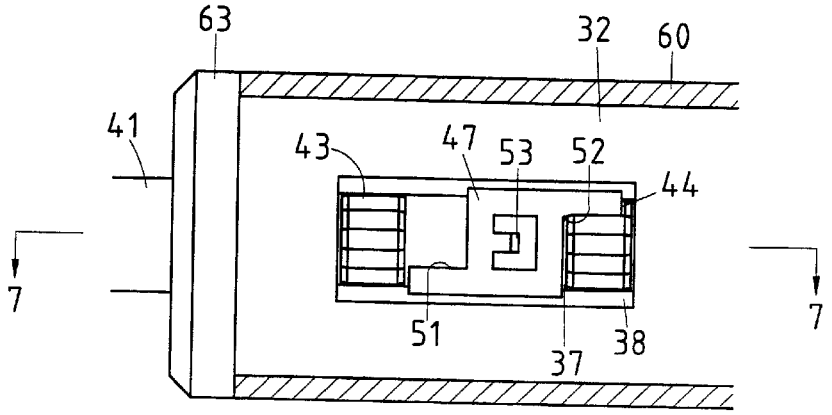
FIG. 6 shows a detailed view of the dial knob seat showing a position for allowing rotation of the screwdriver in a first direction.
Figures 1, 6:
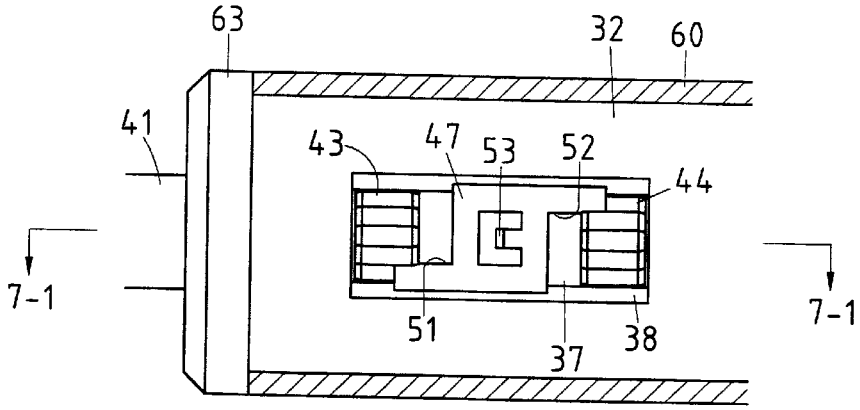
Figures 2, 6:
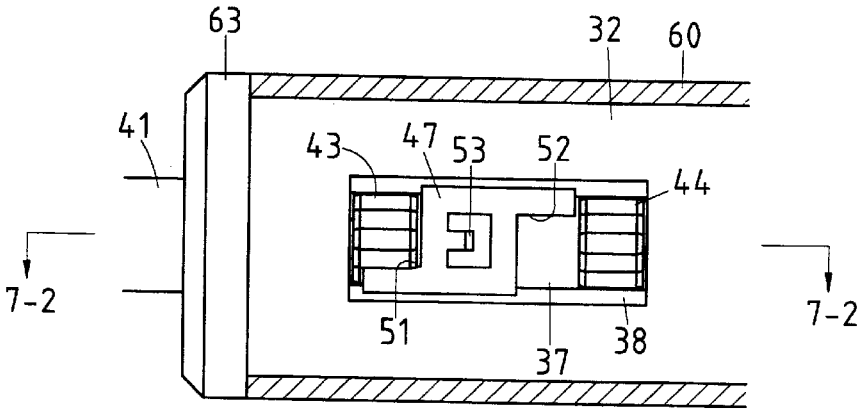
Figure 7:
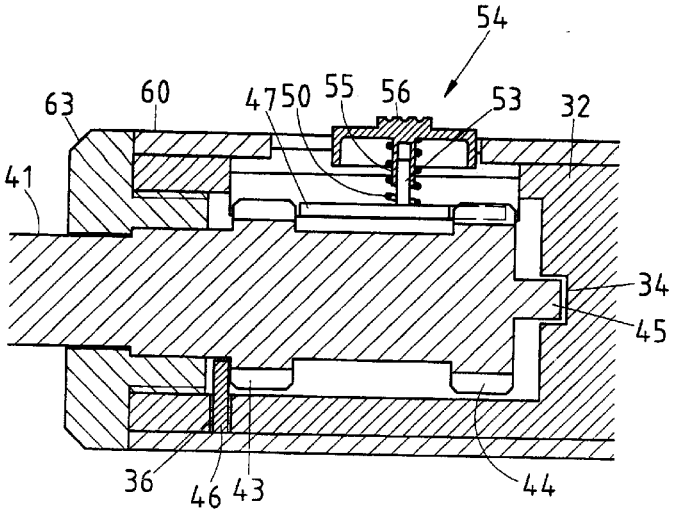
FIG. 7 is a cross-sectional view of the handle as taken across lines 7—7 of FIG. 6.
Figures 1, 7:
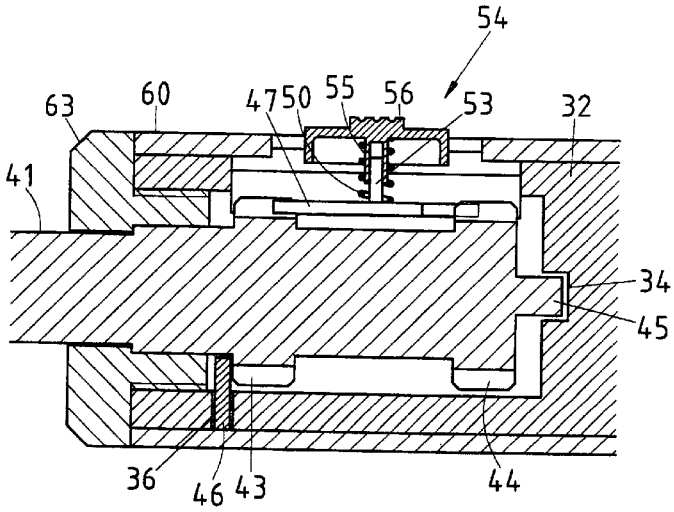
Figures 2, 7:
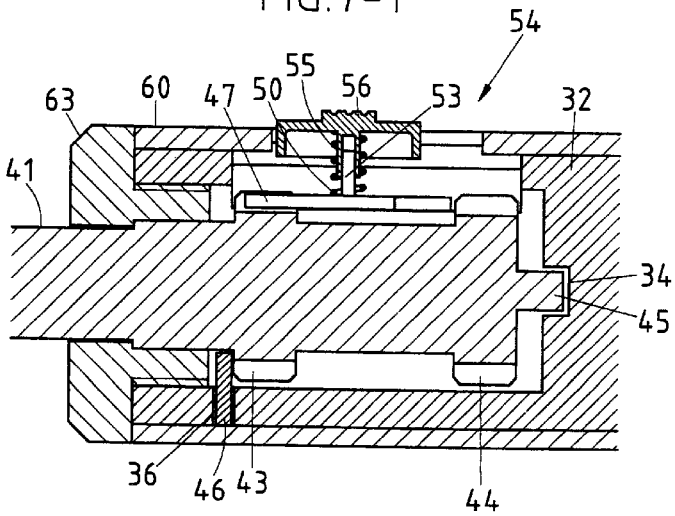

As shown in FIGS. 3 through 7-2, a ratchet screwdriver of the present invention comprises the component parts which are described herenaifter A handle 31 is provided.

A ratchet seat body 32 is provided with a fastening portion 33 which is fastened to the front end of the handle 31. The ratchet seat body 32 is provided at the front end thereof with an axial hole 35 having a heart hole 34. The ratchet seat body 32 is provided in the underside of the front section thereof with an insertion slot 36 in communication with the axial hole 35. The ratchet seat body 32 is provided in the midsection thereof with a slide slot 37 in communication with the axial hole 35. The slide slot 37 is provided in two sides thereof with a slide edge 38. The axial hole 35 is provided at the front end with a threaded mouth 40.

A rotary shaft rod 41 is provided at the front end with a fitting mouth 42 and is provided at the tail section thereof with two gears 43 and 44. The rotary shaft rod 41 is provided with a projected pillar 45 which is pivoted to the heart hole 34 so as to enable the gears 43 and 44 to be received in the center axial hole 35.

A stop plate 46 is disposed in the axial hole 35 such that the first gear 43 is stopped by the stop plate 46.

An anti-reverse plate 47 is slidably mounted on the slide edges 38 of the slide slot 37 and is provided with two anti-reverse edges 51 and 52 for mounting the two gears 43 and 44. The anti-reverse plate 47 is provided with a locating pillar 53.

A dial knob seat 54 is disposed over the anti-reverse plate 47 and is provided with a fitting tube 55 corresponding in location to the locating pillar 53 of the anti-reverse plate 47. The dial knob seat 54 is further provided in the top thereof with a dial block 56 and a locating point 57.

A recovery spring 50 is fitted over the fitting tube 55 which is located between the dial knob seat 54 and the anti-reverse plate 47.

A housing 60 covers the ratchet seat body 32 to prevent the stop plate 46 from slipping out of the insertion slot 36. The housing 60 is provided with a slot 61 corresponding in location to the dial block 56 of the dial knob seat 54. The slot 61 is provided in the fringe thereof with a plurality of locating edges 62 corresponding in location to the locating points 57.

A lock member 63 is provided with a threaded portion 64 which is engaged with the threaded mouth 40 of the axial hole 35, so as to prevent the housing 60 from being disengaged from the ratchet seat body 32. The lock member 63 is provided with a receiving hole 65.

A screw tip 66 is located in the fitting mouth 42 of the rotary shaft rod 41.

The anti-reverse edges 51 and 52 slide back and forth along with the anti-reverse plate 47 such that the two gears 43 and 44 are simultaneously supported by the two anti-reverse edges 51 and 52 or by one of the two anti-reverse edges 51 and 52.

I claim:

1. A ratchet screwdriver comprising:

a handle having a front end;

a ratchet seat body having a fastening portion fastened to said front end of said handle, said ratchet seat body having an axial hole formed at a front end thereof, said ratchet seat body having a heart hole formed interior thereof at an end of said axial hole, said ratchet seat body having an insertion slot formed at an underside of a front section of said ratchet seat body, said ratchet seat body having a slide slot in a midsection thereof, said slide slot in being in communication with said axial hole, said slide slot having slide edges on respective opposite sides thereof, said ratchet seat body having a threaded mouth at said front end thereof;

a rotary shaft rod having a fitting mouth at a front end thereof, said rotary shaft rod having a first gear and a second gear at a tail section thereof, said rotary shaft rod having a projecting pillar pivotally received in said heart hole, said first gear and said second gear being a projecting pillar pivotally received in said heart hole, said first gear and said second gear being received in said axial hole of said ratchet seat body;

a stop plate disposed in said axial hole and cooperative with said first gear;

an anti-reverse plate slidably mounted on said slide edges of said slide slot, said anti-reverse plate having two anti-reverse edges mounted to said first gear and said second gear, said anti-reverse plate having a locating pillar formed thereon;

a dial knob seat disposed over said anti-reverse plate, said locating pillar of said anti-reverse plate, said dial knob seat having a dial block at a top thereof, said dial knob having locating points formed thereon;

a recovery spring fitted over said fitting tube and positioned between said dial knob seat and said anti-reverse plate;

a housing means covering said ratchet seat body for preventing said stop plate from slipping out of said insertion slot, said housing means having a slot corresponding in location to said dial block of said dial knob seat, said slot of said housing means having a plurality of locating edges corresponding respectively to said locating points;

a lock member having a threaded portion engaged with said threaded mouth and suitable for preventing said housing means from disengagement with said ratchet seat body, said lock member having a receiving hole formed therein; and a screw tip received in said fitting mouth of said rotary shaft rod.

* * * * *